US010450722B2

(12) United States Patent
Moriki et al.

(10) Patent No.: US 10,450,722 B2
(45) Date of Patent: Oct. 22, 2019

(54) CONTROL SYSTEM FOR CONSTRUCTION MACHINE

(71) Applicant: HITACHI CONSTRUCTION MACHINERY CO., LTD., Tokyo (JP)

(72) Inventors: Hidekazu Moriki, Tokyo (JP); Hiroshi Sakamoto, Tsuchiura (JP); Yasutaka Tsuruga, Tsuchiura (JP); Tadashi Osaka, Tokyo (JP); Ryu Narikawa, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 15/778,301

(22) PCT Filed: Nov. 11, 2016

(86) PCT No.: PCT/JP2016/083518
§ 371 (c)(1),
(2) Date: May 23, 2018

(87) PCT Pub. No.: WO2017/090465
PCT Pub. Date: Jun. 1, 2017

(65) Prior Publication Data

US 2018/0347150 A1 Dec. 6, 2018

(30) Foreign Application Priority Data

Nov. 25, 2015 (JP) ..... 2015-230136

(51) Int. Cl.
*E02F 9/20* (2006.01)
*B66C 23/86* (2006.01)
(Continued)

(52) U.S. Cl.
CPC ..... *E02F 9/2033* (2013.01); *B66C 23/86* (2013.01); *E02F 3/32* (2013.01); *E02F 3/425* (2013.01);
(Continued)

(58) Field of Classification Search
USPC ..... 701/50
See application file for complete search history.

(56) References Cited

U.S. PATENT DOCUMENTS

2004/0133327 A1* 7/2004 Ishimoto ..... E02F 9/2228 701/50
2009/0148310 A1* 6/2009 Satake ..... E02F 9/226 417/228
(Continued)

FOREIGN PATENT DOCUMENTS

JP 63-55222 A 3/1988
JP 63-070722 A 3/1988
(Continued)

OTHER PUBLICATIONS

International Search Report of PCT/JP2016/083518 dated Feb. 7, 2017.
(Continued)

*Primary Examiner* — Masud Ahmed
(74) *Attorney, Agent, or Firm* — Mattingly & Malur, PC

(57) ABSTRACT

A control system for a construction machine stops an upper swing structure at a desired swing stop angle. A main controller sets a swing stop target angle at which an upper swing structure is to be stopped. A swing stoppability determination section reads an angle signal of the upper swing structure with respect to an undercarriage and an angle of a work implement, and determines whether the swing of the upper swing structure can be stopped at the swing stop target angle. A work implement is controlled in
(Continued)

such a manner that an extension action of the work implement in a swing radial direction is prohibited or a contraction action of the work implement in the swing radial direction is executed in response to a signal that indicates whether the swing can be stopped and that is determined by the swing stoppability determination section.

4 Claims, 10 Drawing Sheets

(51) Int. Cl.

| | |
|---|---|
| ***E02F 9/22*** | (2006.01) |
| ***F15B 11/04*** | (2006.01) |
| ***E02F 3/32*** | (2006.01) |
| ***E02F 3/42*** | (2006.01) |
| ***E02F 3/43*** | (2006.01) |
| ***E02F 9/12*** | (2006.01) |
| ***E02F 9/26*** | (2006.01) |
| ***F15B 15/18*** | (2006.01) |
| ***F15B 15/28*** | (2006.01) |
| *B66C 13/18* | (2006.01) |
| *B66C 23/82* | (2006.01) |
| *F15B 13/02* | (2006.01) |

(52) U.S. Cl.

CPC ..... *E02F 3/435* (2013.01); *E02F 9/123* (2013.01); *E02F 9/2004* (2013.01); *E02F 9/22* (2013.01); *E02F 9/2225* (2013.01); *E02F 9/2267* (2013.01); *E02F 9/26* (2013.01); *F15B 11/04* (2013.01); *F15B 15/18* (2013.01); *F15B 15/2815* (2013.01); *B66C 13/18* (2013.01); *B66C 23/82* (2013.01); *F15B 13/02* (2013.01)

(56) References Cited

U.S. PATENT DOCUMENTS

| | | | | |
|---|---|---|---|---|
| 2010/0183416 | A1* | 7/2010 | Ishii | B25J 9/0087 414/680 |
| 2010/0264106 | A1 | 10/2010 | Kawai et al. | |
| 2013/0116897 | A1 | 5/2013 | Lee et al. | |
| 2013/0332036 | A1* | 12/2013 | Yamamoto | E02F 9/123 701/50 |
| 2015/0330060 | A1* | 11/2015 | Seki | E02F 9/264 701/33.1 |
| 2016/0376772 | A1* | 12/2016 | Kondo | E02F 9/264 701/34.4 |

FOREIGN PATENT DOCUMENTS

| | | | |
|---|---|---|---|
| JP | 2010-076904 | A | 4/2010 |
| JP | 2010-247968 | A | 11/2010 |
| JP | 2012-021290 | A | 2/2012 |
| JP | 2013-535593 | A | 9/2013 |

OTHER PUBLICATIONS

International Preliminary Report on Patentability received in corresponding International Application No. PCT/JP2016/083518 dated Jun. 7, 2018.

* cited by examiner

CONTROL SYSTEM FOR CONSTRUCTION MACHINE

TECHNICAL FIELD

The present invention relates to a control system for a construction machine.

BACKGROUND ART

Generally, when conducting work for loading excavated objects into a dump truck using a hydraulic excavator that is a construction machine, then an operator causes a work implement to execute a boom raising action while controlling an upper swing structure to rotate or swing by operator's simultaneous adjustment of a swing angle and a height of the work implement using operation devices, and moves the work implement from an excavation position to an upper position of a cargo stand of the dump truck to discharge the excavated objects.

The upper swing structure continues swinging through inertia even after the operator stops a swing operation, and a swing stop angle varies depending on a swing speed and swing inertia at the time of stopping the swing operation. For this reason, it is necessary to determine stop timing of the swing operation in the light of an increase of the swing stop angle by the inertia for stopping the upper swing structure at a desired swing angle. In this way, when performing a combined operation involving the swing action or the swing stop operation for stopping the upper swing structure at a desired position, the operator is required to operate the hydraulic excavator with a higher degree of concentration. In addition, operator's monitoring awareness of surroundings is diminished because of the concentration of awareness on operating the hydraulic excavator. For example, when an approaching object to a swing range of the work implement is present, the discovery of the approaching object is possibly delayed.

There are known a construction machine swing control system and a method thereof that can stop an upper swing structure in a predetermined range even if an operator stops a swing operation for which the operator is required to have a high degree of concentration as described above at different timing (refer to, for example, Patent Document 1). According to the construction machine swing control system and the method thereof, an optimum swing-operation-stop starting position for stopping the upper swing structure in the predetermined range is estimated, a stop target position is calculated using a current swing position and the stop starting position, and a swing motor is then controlled such that the upper swing structure is stopped at the stop target position. It is thereby possible to stop the swing of the upper swing structure in the predetermined range even if the operator stops the swing operation at the different timing.

There are also known a swing work machine and a swing work machine control method for detecting an approaching object described above to a swing range of the work implement and stopping the swing (refer to, for example, Patent Document 2). According to the swing work machine and the swing work machine control method, it is determined whether there is a probability of interference between the swing work machine and the approaching object on the basis of a current swing speed, current swing inertia, and a position of the approaching object, and a swing action is controlled.

PRIOR ART DOCUMENT

Patent Document

Patent Document 1: JP-2013-535593-T
Patent Document 2: JP-2012-021290-A

SUMMARY OF THE INVENTION

Problem to be Solved by the Invention

A technique of Patent Document 1 calculates the stop target position using the current swing position and the stop starting position. Furthermore, a technique of Patent Document 2 determines the probability of the interference with the approaching object on the basis of the current swing speed, the current swing inertia, and the position of the approaching object. Owing to this, changes (of the swing inertia and the swing stop target position) that occur after, for example, the stop of the swing operation is started are not possibly, sufficiently considered.

For example, when an arm extending action is executed in a state in which the operator performs the swing stop operation but the upper swing structure is not completely stopped yet, the swing inertia increases from that at timing of the stop operation. However, the techniques of Patent Documents 1 and 2 do not give consideration to corrections in such a case.

Furthermore, at the time of loading the excavated objects into the dump truck, a boom raising action is executed while causing the upper swing structure to swing, and the work implement is moved from the excavation position to the upper position of the cargo stand of the dump truck. However, when the boom raising action is delayed, a contact possibly occurs between the cargo stand of the dump truck and the work implement. For avoidance of this contact, it is necessary to stop the swing of the upper swing structure earlier than the start to stop the swing operation. It is also necessary to stop the swing of the upper swing structure earlier than arrival at a predetermined stop position when the approaching object approaches a machine body after the approaching object is detected during swing work and the operator stops the swing operation. In such a case, a speed reduction torque exceeding a maximum value of a torque that can be output by a swing motor, with the result that the operator is unable to stop the swing of the upper swing structure at the desired swing stop angle.

The present invention has been achieved on the basis of the circumstances described above, and an object of the present invention is to provide a control system for a construction machine that can stop an upper swing structure at a desired swing stop angle.

Means for Solving the Problem

To solve the problems, the present invention adopts, for example, a configuration according to claims. The present application includes a plurality of means for solving the problem. As an example of the means, there is provided a control system for a construction machine comprising: an undercarriage; an upper swing structure rotatably mounted to swing on the undercarriage; a work implement attached to the upper swing structure to be able to rotate vertically thereto; a swing hydraulic actuator that drives the upper swing structure to swing; work implement hydraulic actuators that drive the work implement; a hydraulic pump; work implement control valves and a swing control valve configured to exercise control of flow rates and directions of hydraulic fluids supplied from the hydraulic pump to the work implement hydraulic actuators and the swing hydraulic actuator; work implement operation devices and a swing operation device configured to instruct the work implement and the upper swing structure to be actuated; and a main controller configured to output drive signals to the work implement control valves and the swing control valve on the basis of instruction signals from the work implement operation devices and the swing operation device, wherein the control system further comprises: a first angle sensor configured to detect a swing angle of the upper swing structure with respect to the undercarriage; and a second angle sensor configured to detect an elevation angle of the work implement with respect to the upper swing structure, and the main controller comprises: a swing stop target angle setting section configured to set a swing stop target angle of the upper swing structure; a swing control section configured to calculate the drive signal on the basis of a difference between the swing angle of the upper swing structure detected by the first angle sensor and the swing stop target angle set by the swing stop target angle setting section and the instruction signal from the swing operation device, and to output the drive signal to the swing control valve; a swing stoppability determination section configured to determine whether a swing action can be stopped before an angle of the upper swing structure reaches the swing stop target angle on the basis of the swing angle of the upper swing structure detected by the first angle sensor, the swing stop target angle set by the swing stop target angle setting section, and the elevation angle of the work implement detected by the second angle sensor; and a work implement control section configured to output a drive signal to the work implement control valve in such a manner that when a determination result of the swing stoppability determination section is No, an action of the work implement in a direction in which at least a swing moment of inertia increases is limited or prohibited.

Advantages of the Invention

According to the present invention, the control system for a construction machine includes the swing stoppability determination section that determines whether the swing can be stopped, and the work implement control section that either prohibits the work implement from executing the extension action in a swing radial direction or allows the work implement to execute the contraction action in the swing radial direction in response to the signal indicating whether the swing can be stopped. Therefore, it is possible to suppress the increase of the swing inertia and reduce the swing inertia. It is thereby possible to stop the upper swing structure at the desired swing stop angle.

BRIEF DESCRIPTION OF THE DRAWINGS

FIG. 4(*b*) is a conceptual diagram showing a front view of the hydraulic excavator including the one embodiment of the control system for the construction machine according to the present invention, and explaining the loading target position, the loading target swing angle, the loading target height, and the lower limit of the work implement height related to the computing contents of the main controller.

MODES FOR CARRYING OUT THE INVENTION

Embodiments of a control system for a construction machine according to the present invention will be explained hereinafter with reference to the drawings.

Figure 1:
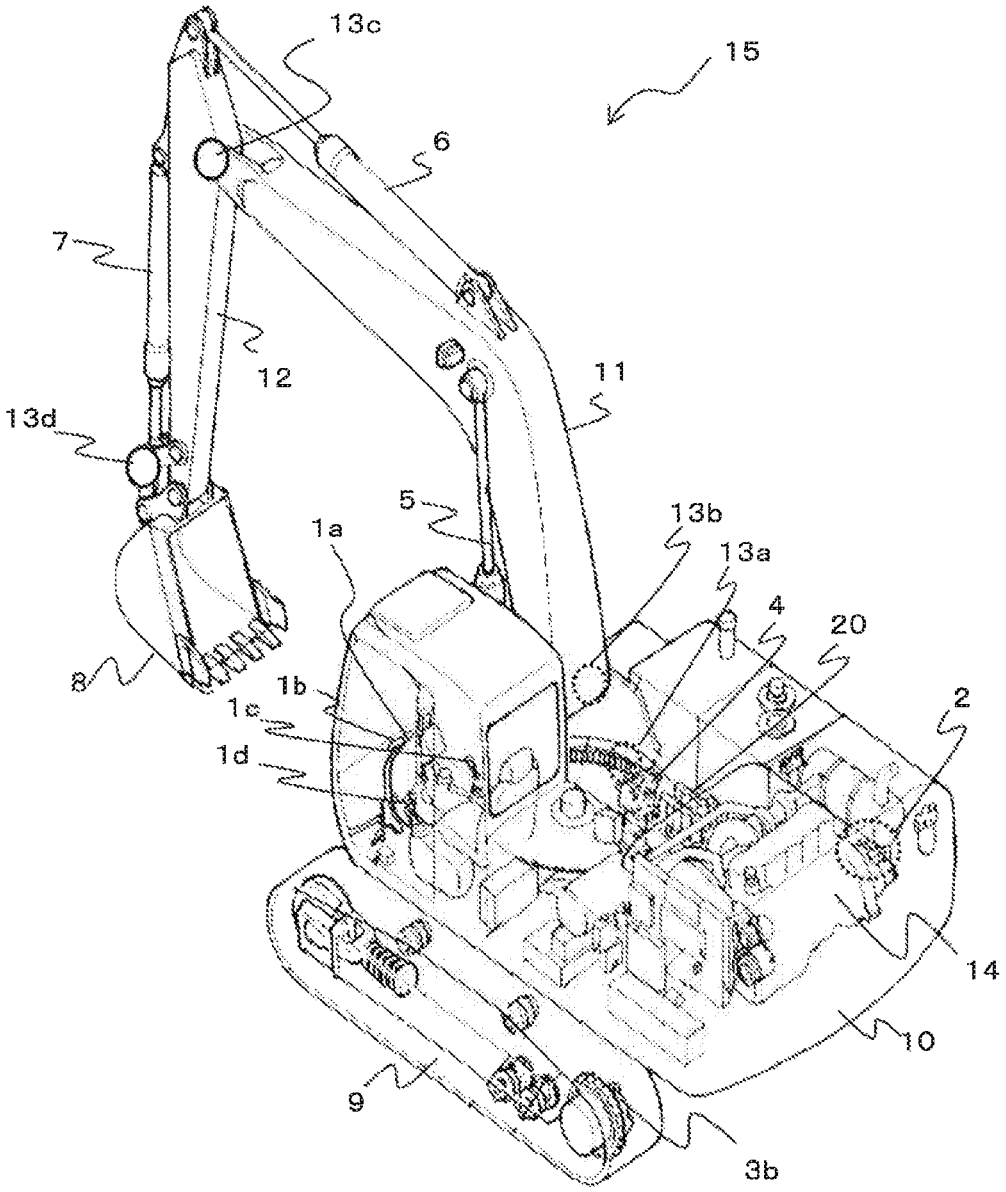
FIG. 1 is a perspective view showing a hydraulic excavator including one embodiment of a control system for a construction machine according to the present invention.

FIG. 1 is a perspective view showing a hydraulic excavator including one embodiment of the control system for the construction machine according to the present invention. As shown in FIG. 1, the hydraulic excavator includes an undercarriage 9, an upper swing structure 10, and a work implement 15. The undercarriage 9 has left and right crawler belt travel devices, which are driven by left and right travel hydraulic motors 3*b* and 3*a* (only the left travel hydraulic motor 3*b* is shown). The upper swing structure 10 is rotatably mounted on the undercarriage 9 and driven to swing by a swing hydraulic motor 4. The upper swing structure 10 includes an engine 14 that serves as a prime mover and a hydraulic pump device 2 driven by the engine 14.

The work implement 15 is attached to a front portion of the upper swing structure 10 in such a manner as to be able to be rotate vertically or elevated. The upper swing structure 10 is provided with an operation room, and operation devices such as a travel right operation lever device 1*a*, a travel left operation lever device 1*b*, and a right operation lever device 1*c* and a left operation lever device 1*d* for instructing the work implement 15 in actions and a swing action are disposed in the operation room.

The work implement 15 has a multijoint structure having a boom 11, an arm 12, and a bucket 8. The boom 11 rotates vertically with respect to the upper swing structure 10 by extension/contraction of a boom cylinder 5, the arm 12 rotates vertically and longitudinally with respect to the boom 11 by extension/contraction of an arm cylinder 6, and the bucket 8 rotates vertically and longitudinally with respect to the arm 12 by extension/contraction of a bucket cylinder 7.

Furthermore, the work implement 15 includes: for calculating a position of the work implement 15, a first angle sensor 13*a* that is provided near a coupling portion between the undercarriage 9 and the upper swing structure 10 and that detects a swing angle of the upper swing structure 10 with respect to the undercarriage 9; a second angle sensor 13*b* that is provided near a coupling portion between the upper swing structure 10 and the boom 11 and that detects an angle (elevation angle) of the boom 11 with respect to a horizontal surface; a third angle sensor 13*c* that is provided near a coupling portion between the boom 11 and the arm 12 and that detects an angle of the arm 12; and a fourth angle sensor 13*d* that is provided near a coupling portion between the arm 12 and the bucket 8 and that detects an angle of the bucket 8. Angle signals detected by these first to fourth angle sensors 13*a* to 13*d* are input to a main controller 100 to be described later.

A control valve 20 exercises control over a flow (a flow rate and a direction) of a hydraulic fluid supplied from the hydraulic pump device 2 to each of hydraulic actuators including the boom cylinder 5, the arm cylinder 6, the bucket cylinder 7, and the left and right travel hydraulic motors 3*b* and 3*a* described above.

Figure 2:
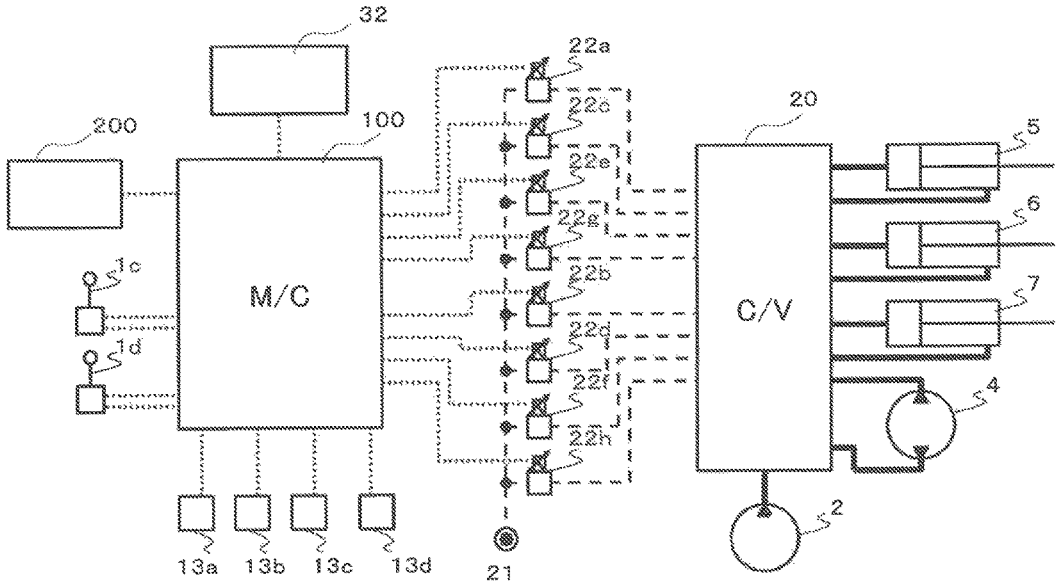
FIG. 2 is a conceptual diagram showing a configuration of a hydraulic drive system of a construction machine including the one embodiment of the control system for the construction machine according to the present invention.

FIG. 2 is a conceptual diagram showing a configuration of a hydraulic drive system of the construction machine including the one embodiment of the control system for the construction machine according to the present invention. For brevity of explanation, devices related to the undercarriage 9 that is of no direct relevance to the embodiments of the present invention will not be shown in FIG. 2 and not explained.

In FIG. 2, the hydraulic drive system includes the hydraulic pump device 2, the swing hydraulic motor 4 that is a swing hydraulic actuator, the boom cylinder 5, the arm cylinder 6, and the bucket cylinder 7 that are work implement hydraulic actuators, the right operation lever device 1*c*, the left operation lever device 1*d*, the control valve 20, a pilot hydraulic fluid source 21, solenoid proportional valves 22*a* to 22*h*, the first to fourth angle sensors 13*a* to 13*d*, and a radar device 32. It is noted that the radar device 32 is an approaching object sensor that detects an approaching object near the hydraulic excavator.

The hydraulic pump device 2 delivers the hydraulic fluid, and supplies the hydraulic fluid to the swing hydraulic motor 4, the boom cylinder 5, the arm cylinder 6, and the bucket cylinder 7 via the control valve 20.

The control valve 20 includes a directional control valve that serves as a swing control valve that exercises control over the flow rate and the direction of the hydraulic fluid supplied to the swing hydraulic motor 4 that is the swing hydraulic actuator, and directional control valves that serve as work implement control valves each exercising control over the flow rate and the direction of the hydraulic fluid supplied to each of the boom cylinder 5, the arm cylinder 6, the bucket cylinder 7, and the like that are the work implement hydraulic actuators. The directional control valves are driven to operate by pilot hydraulic fluids supplied from the corresponding solenoid proportional valves 22*a* to 22*h*.

The solenoid proportional valves 22*a* to 22*h* each use the pilot hydraulic fluid supplied from the pilot hydraulic fluid source 21 as a primary pressure, and output a pressure-reduced secondary pilot hydraulic fluid to an operation section of each directional control valve in response to a drive signal from the main controller 100. A relationship between the directional control valves and the solenoid proportional valves is defined as follows. The boom directional control valve is driven to operate by the pilot hydraulic fluid supplied to the operation section via the boom raising solenoid proportional valve 22*c* and the boom lowering solenoid proportional valve 22*d*. The arm directional control valve is driven to operate by the pilot hydraulic fluid supplied to the operation section via the arm crowding solenoid proportional valve 22*e* and the arm dumping solenoid proportional valve 22*f*. The bucket directional control valve is driven to operate by the pilot hydraulic fluid supplied to the operation section via the bucket crowding solenoid proportional valve 22*g* and the bucket dumping solenoid proportional valve 22*h*. The swing directional control valve is driven to operate by the pilot hydraulic fluid supplied to the operation section via the swing right solenoid proportional valve 22*a* and the swing left solenoid proportional valve 22*b*.

The right operation lever device 1*c* outputs voltage signals depending on an operation amount and an operation direction of an operation lever to the main controller 100 as a boom operation signal and a bucket operation signal. Likewise, the left operation lever device 1*d* outputs voltage signals depending on an operation amount and an operation direction of an operation lever to the main controller 100 as a swing operation signal and an arm operation signal.

The boom and the bucket operation signal transmitted from the right operation lever device 1*c*, the swing operation signal and the arm transmitted from the left operation lever device 1*d*, the swing angle, the boom angle, the arm angle, and the bucket angle transmitted from the first to fourth angle sensors 13*a* to 13*d*, position information on the approaching object detected near a work region and transmitted from the radar device 32, and a loading target position signal transmitted from an information controller 200 are input to the main controller 100. The main controller 100 computes command signals for driving the solenoid proportional valves 22*a* to 22*h* in response to these input signals, and output the command signals to the solenoid proportional valves 22*a* to 22*h*.

It is noted that a method of inputting the loading target position signal set by the information controller 200 may be, for example, a method of inputting a loading position into a dump truck in numeric values as the angles of the hydraulic actuators. In addition, means of the radar device 32 for acquiring a position of the approaching object may be a camera, a millimeter wave radar, or the like. Computation performed by the information controller 200 and the radar device 32 is not directly relevant to characteristics of the present invention; thus, explanation thereof will be omitted.

Figure 3:
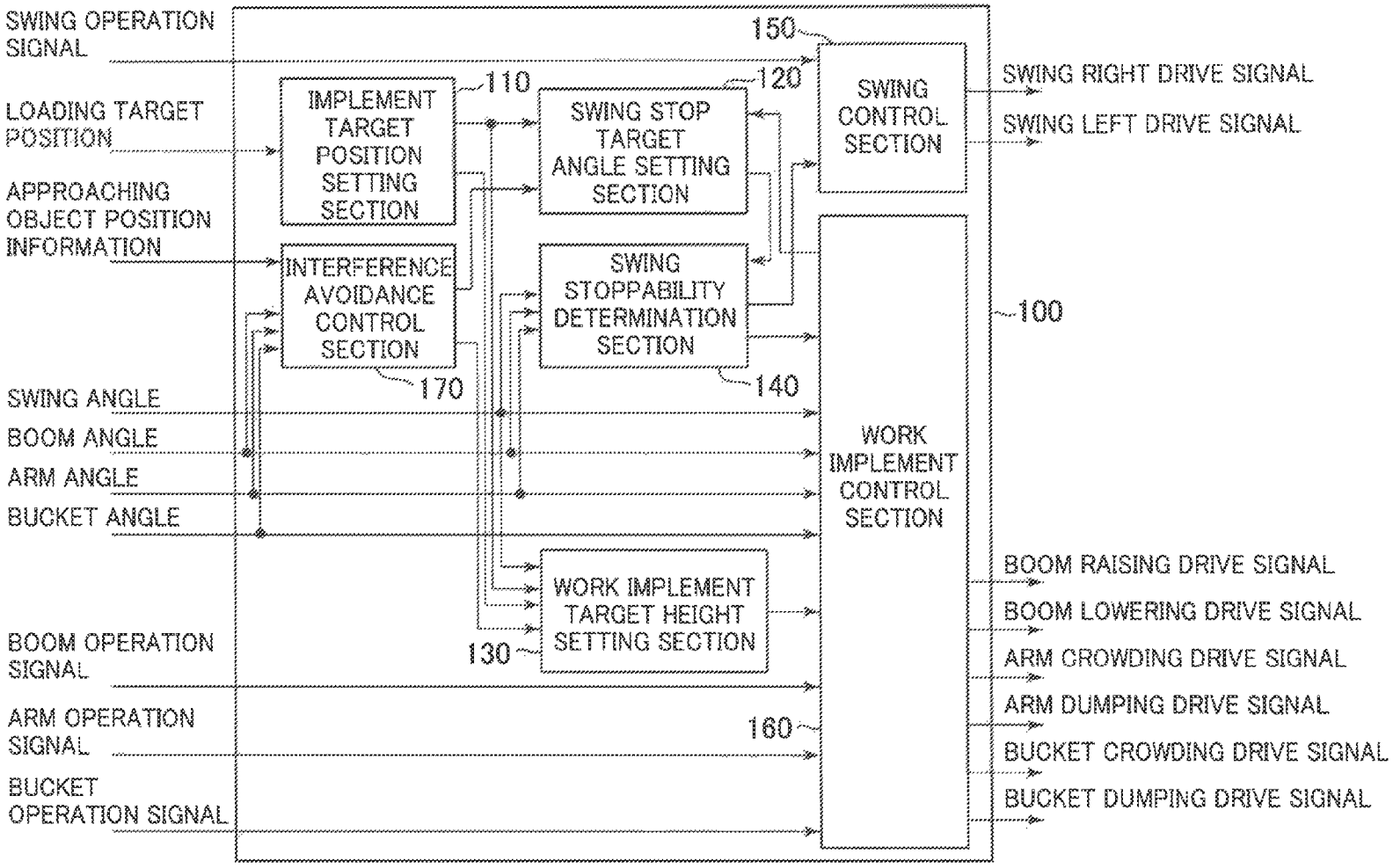
FIG. 3 is a conceptual diagram showing a configuration of a main controller that configures the one embodiment of the control system for the construction machine according to the present invention.
Figure 4A:
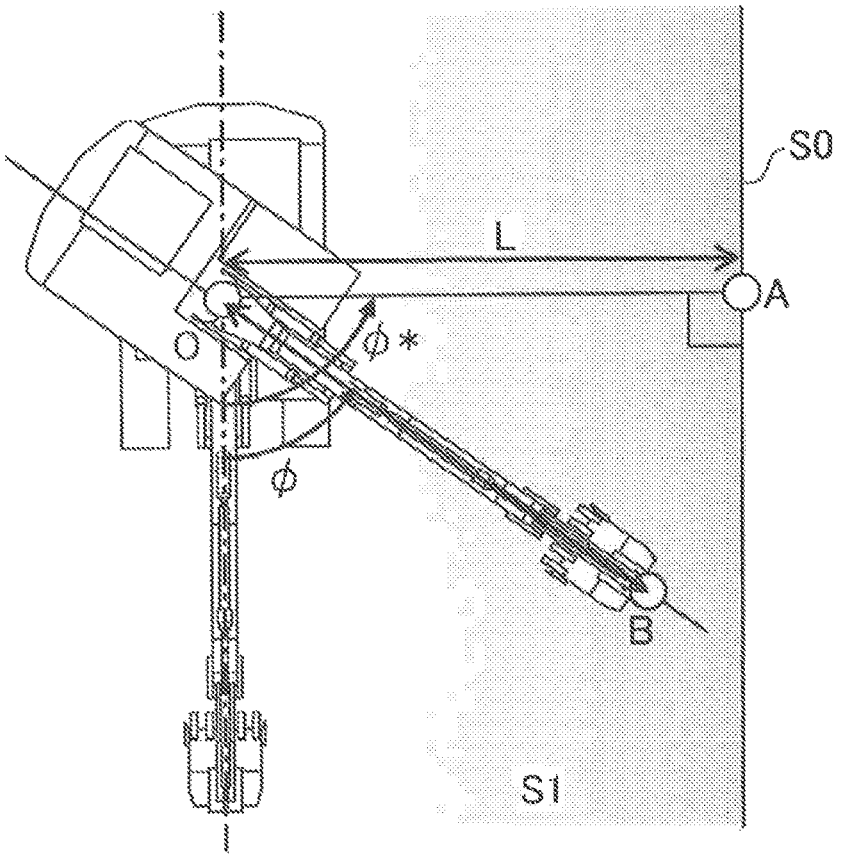
FIG. 4(*a*) is a conceptual diagram showing a plan view of the hydraulic excavator including the one embodiment of the control system for the construction machine according to the present invention, and explaining a loading target position, a loading target swing angle, a loading target height, and a lower limit of a work implement height related to computing contents of the main controller.
Figure 4B:
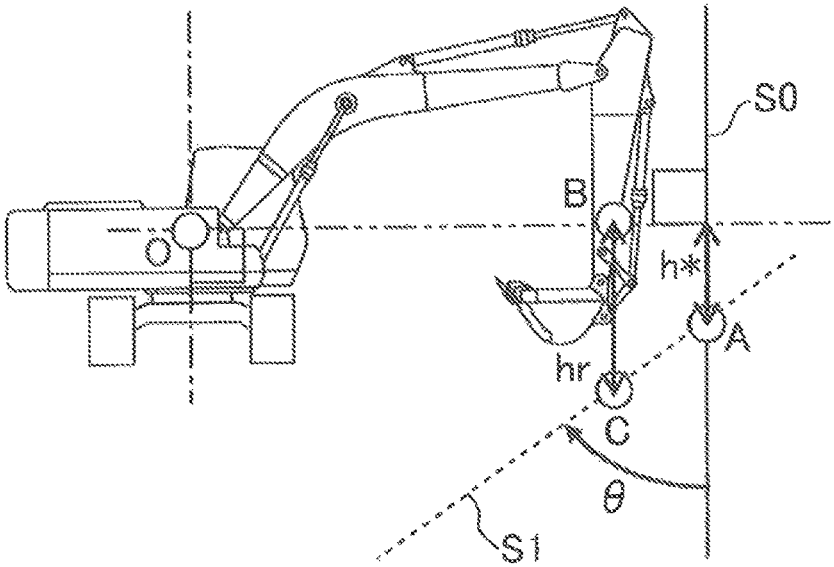

The main controller 100 that configures the one embodiment of the control system for the construction machine according to the present invention will next be explained with reference to the drawings. FIG. 3 is a conceptual diagram showing a configuration of the main controller that configures the one embodiment of the control system for the construction machine according to the present invention. FIG. 4(*a*) is a conceptual diagram showing a plan view of the hydraulic excavator including the one embodiment of the control system for the construction machine according to the present invention, and explaining a loading target position, a loading target swing angle, a loading target height, and a lower limit of a work implement height related to computing contents of the main controller. FIG. 4(*b*) is a conceptual diagram showing a front view of the hydraulic excavator including the one embodiment of the control system for the construction machine according to the present invention, and explaining the loading target position, the loading target swing angle, the loading target height, and the lower limit of the work implement height related to the computing contents of the main controller.

As shown in FIG. 3, the main controller 100 includes a work implement target position setting section 110, a swing stop target angle setting section 120, a work implement target height setting section 130, a swing stoppability determination section 140, a swing control section 150, a work implement control section 160, and an interference avoidance control section 170.

The work implement target position setting section 110 computes the loading target swing angle and the loading target height on the basis of the loading target position signal transmitted from the information controller 200, outputs a calculated loading target swing angle signal to the swing stop target angle setting section 120 and the work implement target height setting section 130, and outputs a loading target height signal to the work implement target height setting section 130. It is noted that the work implement target position is a target position at which a tip end (bucket 8) of the work implement is disposed.

The swing stop target angle setting section 120 corrects the loading target swing angle calculated by the work implement target position setting section 110 to compute a swing stop target angle signal, and outputs the calculated swing stop target angle signal to the swing stoppability determination section 140. Details of computation performed by the swing stop target angle setting section 120 will be described later.

The work implement target height setting section 130 calculates a lower limit value of the work implement height from the loading target swing angle signal and the loading target height signal calculated by the work implement target position setting section 110, computes a work implement target height depending on the swing angle on the basis of the lower limit value of the work implement height, and outputs a calculated work implement target height signal to the work implement control section 160.

The loading target position, the loading target swing angle, the loading target height, and the lower limit of the work implement height will now be explained with reference to FIGS. 4(*a*) and 4(*b*). FIGS. 4(*a*) and 4(*b*) are a plan view and a front view of the hydraulic excavator, respectively.

In FIGS. 4(*a*) and 4(*b*), a point O denotes an origin of a coordinate system with reference to a front of the undercarriage 9 of the hydraulic excavator, and the point O is at a height equal to that of a boom rotational axis on a swing axis of the hydraulic excavator. In FIGS. 4(*a*) and 4(*b*), φ denotes a swing angle that is a relative angle of a front direction of the upper swing structure 10 with respect to a forward movement direction of the undercarriage 9.

The swing angle φ is the relative angle of the front direction of the upper swing structure 10 with respect to the forward movement direction of the undercarriage 9. Further, a point A in FIGS. 4(*a*) and 4(*b*) denotes the loading target position, which is set to, for example, an upper position of a cargo stand of the dump truck, φ* in FIG. 4(*a*) denotes the loading target swing angle, and h* in FIG. 4(*b*) denotes the loading target height. Moreover, a length between the points O and A in FIG. 4(*a*) that is the plan view is indicated by L.

A plane S1 in FIGS. 4(*a*) and 4(*b*) denotes the lower limit of the work implement height, and the plane S1 is indicated by a broken line in FIG. 4(*b*) and indicated by a gradation part in FIG. 4(*a*). The plane S1 is set in the following procedures. First, in FIG. 4(*a*), a plane including the point A, parallel to the swing axis, and crossing a line OA at a right angle is defined as S0. In FIG. 4(*b*), the plane S1 generated by inclining the plane S0 at the angle θ with respect to a line at the height h* on the plane S0 that serves as an axis is set as the lower limit of the work implement height.

The angle θ is preferably set on the basis of a ratio of a swing maximum angular speed $\omega s_{max}$ to a boom raising maximum angular speed $\omega b_{max}$ in such a manner that the angle θ becomes larger as the swing maximum angular speed is higher. The angle θ may be set using, for example, the following Equation (1).

$$\theta=\tan^{-1}(\omega s_{max}/\omega b_{max}) \quad (1)$$

The work implement target height is computed as a height of a point C (hr in FIG. 4(*b*) that is an intersecting point between the plane S1 and a segment lowered from a point B computed using the swing angle φ and the length L to the plane S1 in parallel to the swing axis.

It is noted that the work implement target height may be computed using a length between a position of a tip end portion of the bucket 8 or the like computed from the boom angle, the arm angle, and the bucket angle and the swing axis as an alternative to the length L.

With reference back to FIG. 3, the swing stop target angle signal from the swing stop target angle setting section 120, the swing angle signal from the first angle sensor 13*a*, the boom angle (elevation angle) signal from the second angle sensor 13*b*, and the arm angle signal from the third angle sensor 13*c* are input to the swing stoppability determination section 140. The swing stoppability determination section 140 determines whether a swing action can be stopped before an angle of the upper swing structure reaches the swing stop target angle in response to the input signals, computes a swing stop angle margin signal and a swing stop angle deviation signal, and outputs the swing stop angle margin signal and the swing stop angle deviation signal to the swing control section 150 and the work implement control section 160, respectively. Details of computation performed by the swing stoppability determination section 140 will be described later.

The swing operation signal from the left operation lever device 1*d* and the swing stop angle margin signal from the swing stoppability determination section 140 are input to the swing control section 150. The swing control section 150 computes a swing right drive signal and a swing left drive signal depending on the input signals, corrects the swing right drive signal and the swing left drive signal depending on the swing stop angle margin signal, and outputs the resultant swing right drive signal and the resultant swing left drive signal to drive the swing right solenoid proportional valve 22*a* and the swing left solenoid proportional valve 22*b*. Details of computation performed by the swing control section 150 will be described later.

The boom and the bucket operation signal from the right operation lever device 1*c*, the arm from the left operation lever device 1*d*, the work implement target height signal from the work implement target height setting section 130, the swing stop angle deviation signal from the swing stoppability determination section 140, the swing angle signal from the first angle sensor 13*a*, the boom angle (elevation angle) signal from the second angle sensor 13*b*, the arm angle signal from the third angle sensor 13*c*, and the bucket angle signal from the fourth angle sensor 13*d* are input to the work implement control section 160. The work implement control section 160 computes a boom raising drive signal, a boom lowering drive signal, an arm crowding drive signal, an arm dumping drive signal, a bucket crowding drive signal, and a bucket dumping drive signal depending on the input signals, and outputs the boom raising drive signal, the boom lowering drive signal, the arm crowding drive signal, the arm dumping drive signal, the bucket crowding drive signal, and the bucket dumping drive signal to drive the boom raising solenoid proportional valve 22*c*, the boom lowering solenoid proportional valve 22*d*, the arm crowding solenoid proportional valve 22*e*, the arm dumping solenoid proportional valve 22*f*, the bucket crowding solenoid proportional valve 22*g*, and the bucket dumping solenoid proportional valve 22*h*, respectively. In addition, the work implement control section 160 computes a deviation between the work implement target height signal and the work implement height computed from the boom angle signal, the arm angle signal, and the bucket angle signal as a work implement height deviation signal, and outputs the work implement height deviation signal to the swing stop target angle setting section 120. Details of computation performed by the work implement control section 160 will be described later.

The position information on the approaching object from the radar device 32, the boom angle signal from the second angle sensor 13*b*, the arm angle signal from the third angle sensor 13*c*, and the bucket angle signal from the fourth angle sensor 13*d* are input to the interference avoidance control section 170. When receiving the approaching object position information, the interference avoidance control section 170 computes an emergency stop target angle signal on the basis of the position of the approaching object, and outputs the emergency stop target angle signal to the swing stop target angle setting section 120. It is noted that the main controller 100 may be configured such that height information in the approaching object position information is compared with a height of the work implement computed from the boom angle, the arm angle, and the bucket angle, and output of the emergency stop target angle signal is stopped when the height of the work implement is sufficiently larger. In addition, the main controller 100 may be configured such that an instruction signal is output to the work implement target height setting section 130 for keeping the work implement target height equal to or larger than the height of the approaching object.

Figure 5:
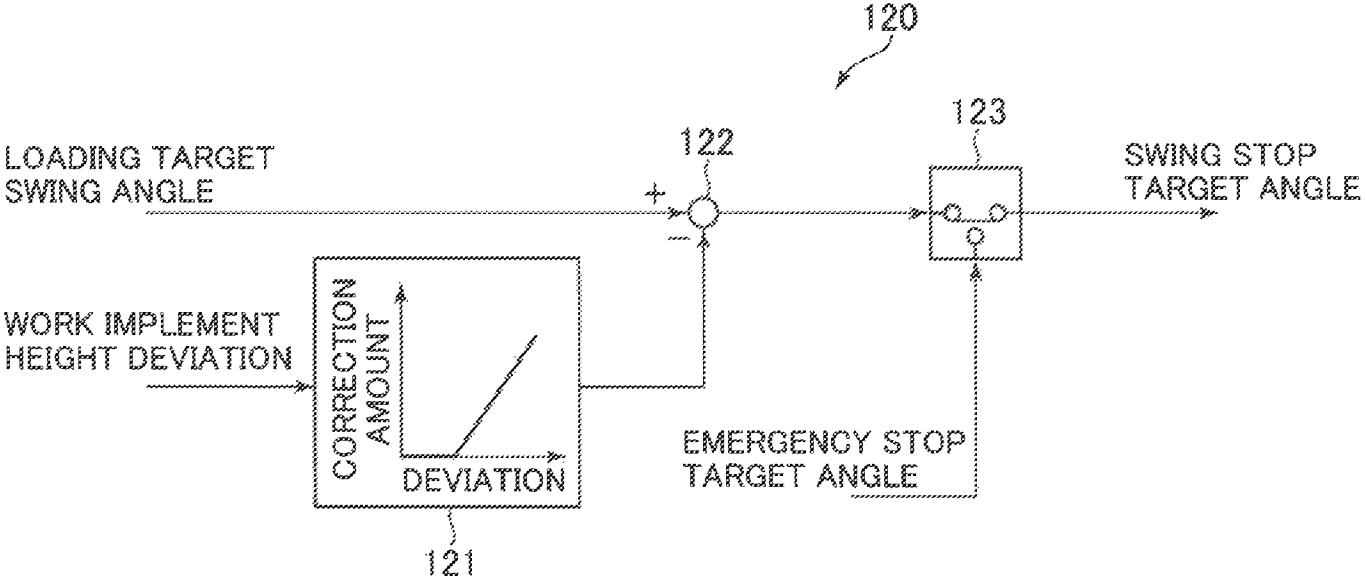
FIG. 5 is a control block diagram showing an example of computing contents of a swing stop target angle setting section of the main controller that configures the one embodiment of the control system for the construction machine according to the present invention.

The details of the computation performed by the swing stop target angle setting section 120 will be explained with reference to FIG. 5. FIG. 5 is a control block diagram showing an example of computing contents of the swing stop target angle setting section of the main controller that configures the one embodiment of the control system for the construction machine according to the present invention. The swing stop target angle setting section 120 computes a swing stop target angle on the basis of the loading target swing angle φ. The swing stop target angle setting section 120 includes a function generating element 121, a subtracting element 122, and a selecting element 123.

The work implement height deviation signal is input to the function generating element 121 from the work implement control section 160. The function generating element 121 computes a correction amount signal depending on the work implement height deviation signal by means of a preset map and outputs the correction amount signal to the subtracting element 122. The subtracting element 122 subtracts the correction amount signal from the loading target swing angle signal output from the work implement target position setting section 110, computes the swing stop target angle, and outputs the swing stop target angle to the selecting element 123. For example, when the work implement height is smaller than the work implement target height, the deviation signal becomes larger and the correction amount becomes larger as well; thus, the swing stop target angle that is output from the subtracting element 122 becomes smaller. This can avoid the interference of the work implement with the dump truck or the like.

The swing stop target angle signal from the subtracting element 122 and the emergency stop target angle signal from the interference avoidance control section 170 are input to the selecting element 123. When the emergency stop target angle signal is not input, the selecting element 123 selects and outputs the swing stop target angle signal from the subtracting element 122. When the emergency stop target angle signal is input, the selecting element 123 selects and outputs this signal. Since this computation sets the swing stop target angle depending on the position of the approaching object, it is possible to avoid the interference of the work implement 15 with the approaching object.

Figure 6:
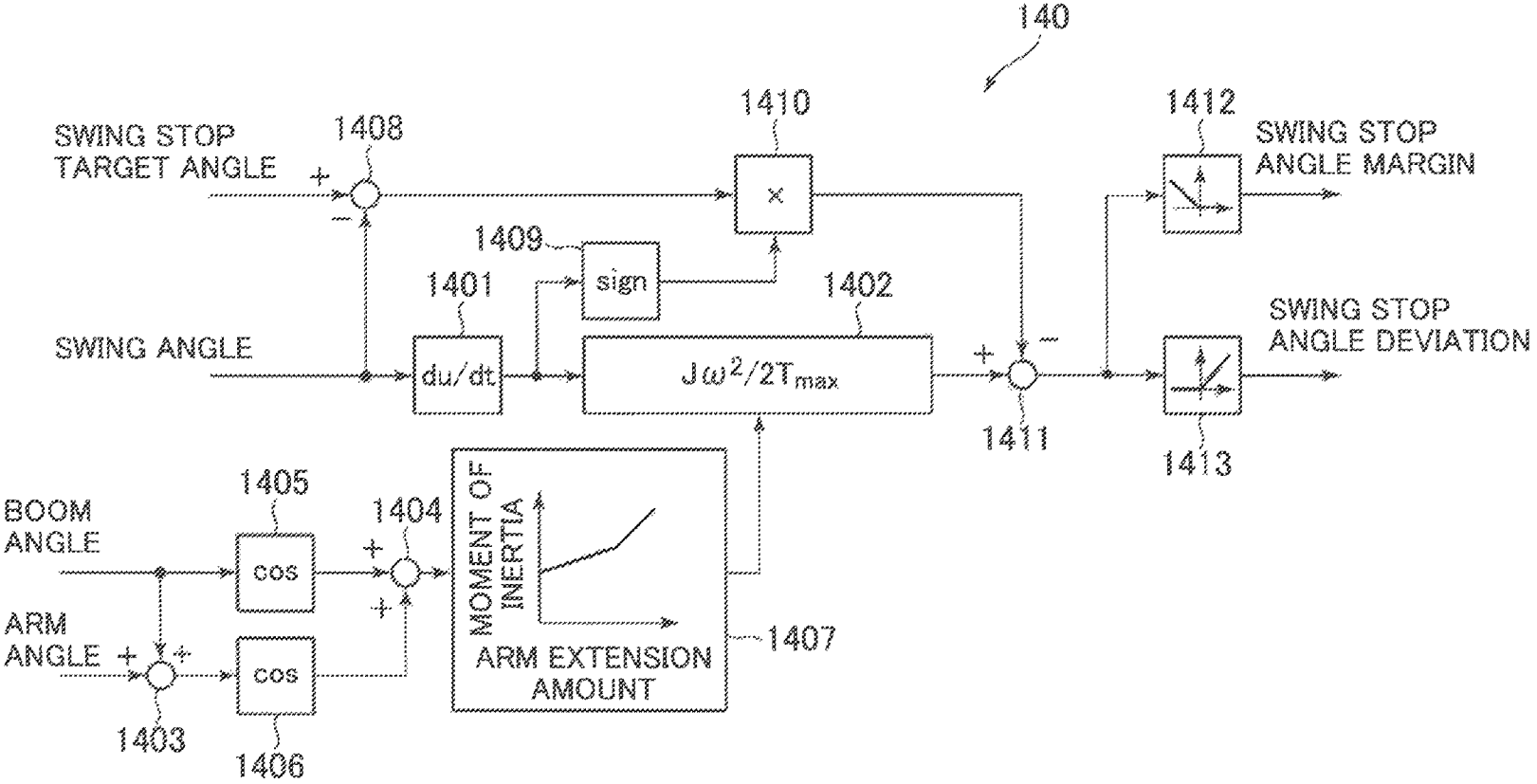
FIG. 6 is a control block diagram showing an example of computing contents of a swing stoppability determination section of the main controller that configures the one embodiment of the control system for the construction machine according to the present invention.

The details of the computation performed by the swing stoppability determination section 140 will next be explained with reference to FIG. 6. FIG. 6 is a control block diagram showing an example of computing contents of the swing stoppability determination section of the main controller that configures the one embodiment of the control system for the construction machine according to the present invention. The swing stoppability determination section 140 determines whether the swing action can be stopped before the angle of the upper swing structure reaches the swing stop target angle on the basis of the swing stop target angle and the swing angle, and computes the swing stop angle margin signal and the swing stop angle deviation signal. The swing stoppability determination section 140 includes a differentiating element 1401, a computing element 1402, a first adding element 1403, a second adding element 1404, a first trigonometric function computing element 1405, a second trigonometric function computing element 1406, a function generating element 1407, a first subtracting element 1408, a sign function computing element 1409, a multiplying element 1410, a second subtracting element 1411, a first extraction computing element 1412, and a second extraction computing element 1413.

The swing angle signal from the first angle sensor 13*a* is input to the differentiating element 1401. The differentiating element 1401 calculates a swing angular speed signal by performing differential computation, and outputs the swing angular speed signal to the computing element 1402 and the sign function computing element 1409.

The boom angle signal from the second angle sensor 13*b* and the arm angle signal from the third angle sensor 13*c* are input to the first adding element 1403. The first adding element 1403 outputs a signal obtained by addition computation to the second trigonometric function computing element 1406. The boom angle signal from the second angle sensor 13*b* is input to the first trigonometric function computing element 1405. The first trigonometric function computing element 1405 computes an extension amount of the boom by performing trigonometric function computation, and outputs the extension amount to the second adding element 1404. The addition signal by adding up the boom angle signal and the arm angle signal from the first adding element 1403 is input to the second trigonometric function computing element 1406. The second trigonometric function computing element 1406 computes an extension amount solely of the arm by performing trigonometric function computation, and outputs the extension amount to the second adding element 1404. An extension amount signal of the boom and an extension amount signal solely of the arm are input to the second adding element 1404. The second adding element 1404 performs addition computation and outputs an arm extension amount signal to the function generating element 1407. The arm extension amount signal is input to the function generating element 1407 from the second adding element 1404. The function generating element 1407 estimates and computes a inertia moment signal J depending on the arm extension amount signal by means of a preset map, and outputs the inertia moment signal J to the computing element 1402.

The swing angular speed signal from the differentiating element 1401 and the inertia moment signal from the function generating element 1407 are input to the computing element 1402. The computing element 1402 computes a swing smallest stop angle signal A using the following Equation (2) and outputs the swing smallest stop angle signal A to the second subtracting element 1411. It is noted that the swing smallest stop angle signal A is a minimum value of an increment of the swing stop angle by the inertia.

$$A=J\omega^2/2T_{max} \tag{2}$$

In Equation (2), ω denotes the swing angular speed signal from the differentiating element 1401, and $T_{max}$ denotes a maximum value of a torque that can be output by the swing hydraulic motor 4 and is set on the basis of a volume, a relief pressure, and the like of the swing hydraulic motor 4. In addition, J denotes the swing inertia moment signal from the function generating element 1407.

The swing stop target angle signal from the swing stop target angle setting section 120 and the swing angle signal from the first angle sensor 13*a* are input to the first subtracting element 1408. The first subtracting element 1408 computes a deviation and outputs the deviation to the multiplying element 1410. The swing angular speed signal from the differentiating element 1401 is input to the sign function computing element 1409. The sign function computing element 1409 computes a sign (+ or −) of the input signal and outputs the sign to the multiplying element 1410.

A deviation signal from the first subtracting element 1408 and a sign signal from the sign function computing element 1409 are input to the multiplying element 1410. The multiplying element 1410 performs multiplication of the input signals, thereby calculating a relative value signal of the swing stop target angle to a current swing angle. The calculated relative value signal of the swing stop target angle to the current swing angle is output to the second subtracting element 1411.

The swing smallest stop angle signal from the computing element 1402 and the relative value signal of the swing stop target angle to the current swing angle from the multiplying element 1410 are input to the second subtracting element 1411. The second subtracting element 1411 computes a deviation between the swing smallest stop angle signal and the relative value signal and outputs the deviation to the first extraction computing element 1412 and the second extraction computing element 1413.

A deviation signal from the second subtracting element 1411 is input to the first extraction computing element 1412. When the input signal is a negative value, the first extraction computing element 1412 computes an absolute value of the input signal and outputs the absolute value. A case in which the deviation signal from the second subtracting element 1411 is the negative value refers to a case in which the swing smallest stop angle signal is smaller than the relative value signal of the swing stop target angle to the current swing stop angle. In this case, the first extraction computing element 1412 determines that swing of the upper swing structure 10 can be stopped before the angle of the upper swing structure 10 reaches the swing stop target angle, extracts the absolute value of the negative value that is the deviation signal as the swing stop angle margin signal, and outputs the swing stop angle margin signal to the swing control section 150.

The deviation signal from the second subtracting element 1411 is input to the second extraction computing element 1413. When the input signal is a positive value, the second extraction computing element 1413 computes an absolute value of the input signal and outputs the absolute value. A case in which the deviation signal from the second subtracting element 1411 is the positive value refers to a case in which the swing smallest stop angle signal is larger than the relative value signal of the swing stop target angle to the current swing angle. In this case, the second extraction computing element 1413 determines that the swing of the upper swing structure 10 cannot be stopped before the angle of the upper swing structure 10 reaches the swing stop target angle, extracts the positive value that is the deviation signal as the swing stop angle deviation signal, and outputs the swing stop angle deviation signal to the work implement control section 160.

Figure 7:
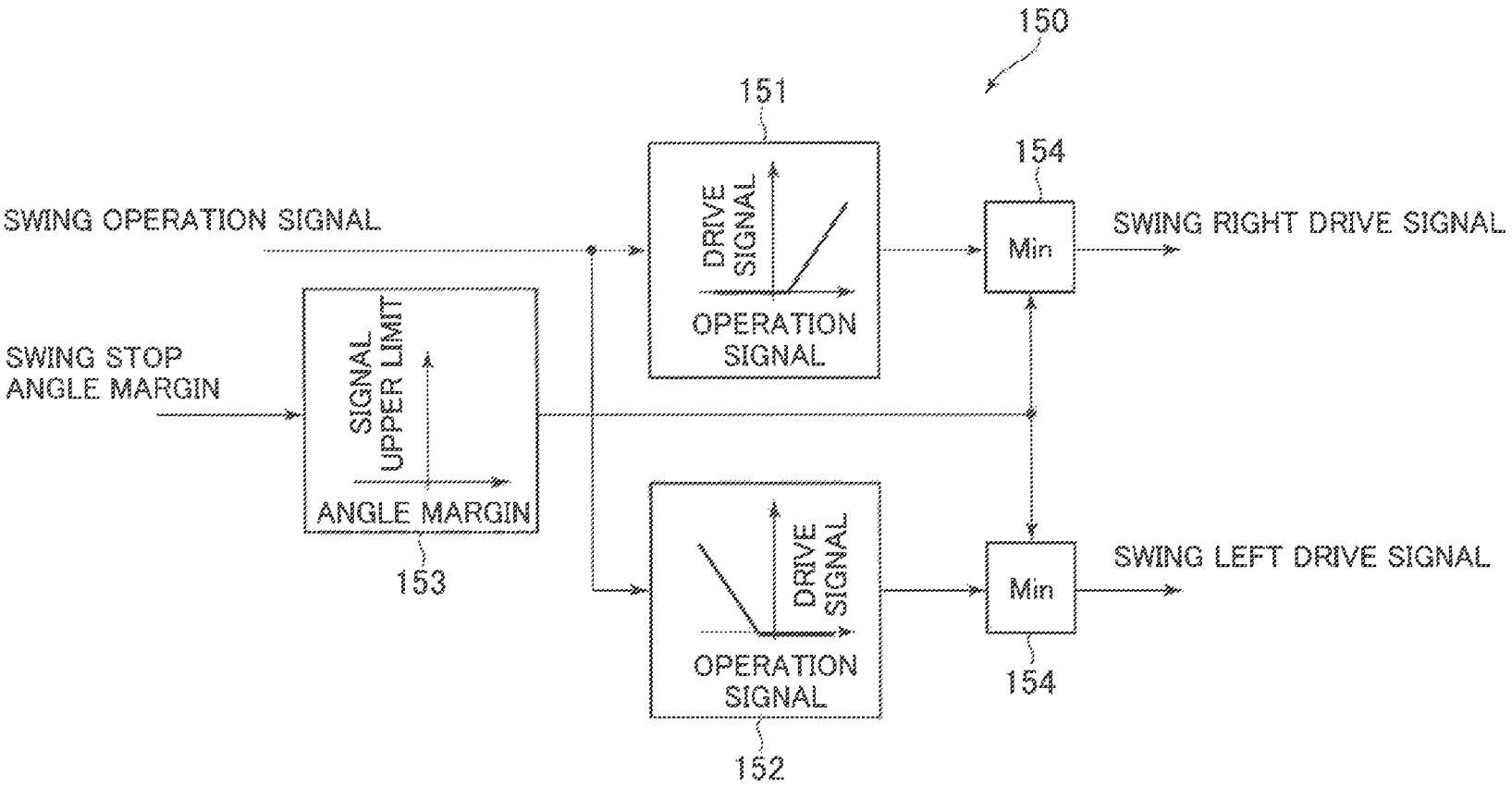
FIG. 7 is a control block diagram showing an example of computing contents of a swing control section of the main controller that configures the one embodiment of the control system for the construction machine according to the present invention.

The details of the computation performed by the swing control section 150 will next be explained with reference to FIG. 7. FIG. 7 is a control block diagram showing an example of computing contents of the swing control section of the main controller that configures the one embodiment of the control system for the construction machine according to the present invention. The swing control section 150 computes the swing right drive signal and the swing left drive signal depending on the swing operation signal and the swing stop angle margin signal. The swing control section 150 includes a first function generating element 151, a second function generating element 152, a third function generating element 153, a first limiting element 154, and a second limiting element 155.

The swing operation signal from the left operation lever device 1*d* is input to the first function generating element 151. The first function generating element 151 computes the swing right drive signal depending on the swing operation signal by means of a preset drive signal map, and outputs the swing right drive signal to the first limiting element 154. Likewise, the swing operation signal from the left operation lever device 1*d* is input to the second function generating element 152. The second function generating element 152 computes the swing left drive signal depending on the swing operation signal by means of a preset drive signal map, and outputs the swing left drive signal to the second limiting element 155.

The swing stop angle margin signal from the swing stoppability determination section 140 is input to the third function generating element 153. The third function generating element 153 computes a swing drive signal upper limit signal depending on the swing stop angle margin signal by means of a preset signal upper limit map, and outputs the swing drive signal upper limit signal to the first and second limiting elements 154 and 155.

The swing right drive signal from the first function generating element 151 and the swing drive signal upper limit signal from the third function generating element 153 are input to the first limiting element 154. The first limiting element 154 outputs the swing right drive signal limited to be equal to or smaller than the swing drive signal upper limit signal. Likewise, the swing left drive signal from the second function generating element 152 and the swing drive signal upper limit signal from the third function generating element 153 are input to the second limiting element 155. The second limiting element 155 outputs the swing left drive signal limited to be equal to or smaller than the swing drive signal upper limit signal. It is noted that the signal upper limit map of the third function generating element 153 is set such that a swing drive signal upper limit becomes larger as the swing stop angle margin signal is larger in a positive direction. Owing to this, when the swing stop angle margin signal is large, the swing right drive signal and the swing left drive signal are output without being limited. As the swing stop angle margin signal is smaller, then the swing right drive signal and the swing left drive signal are limited to be smaller, and a speed of the swing is reduced.

Figure 8:
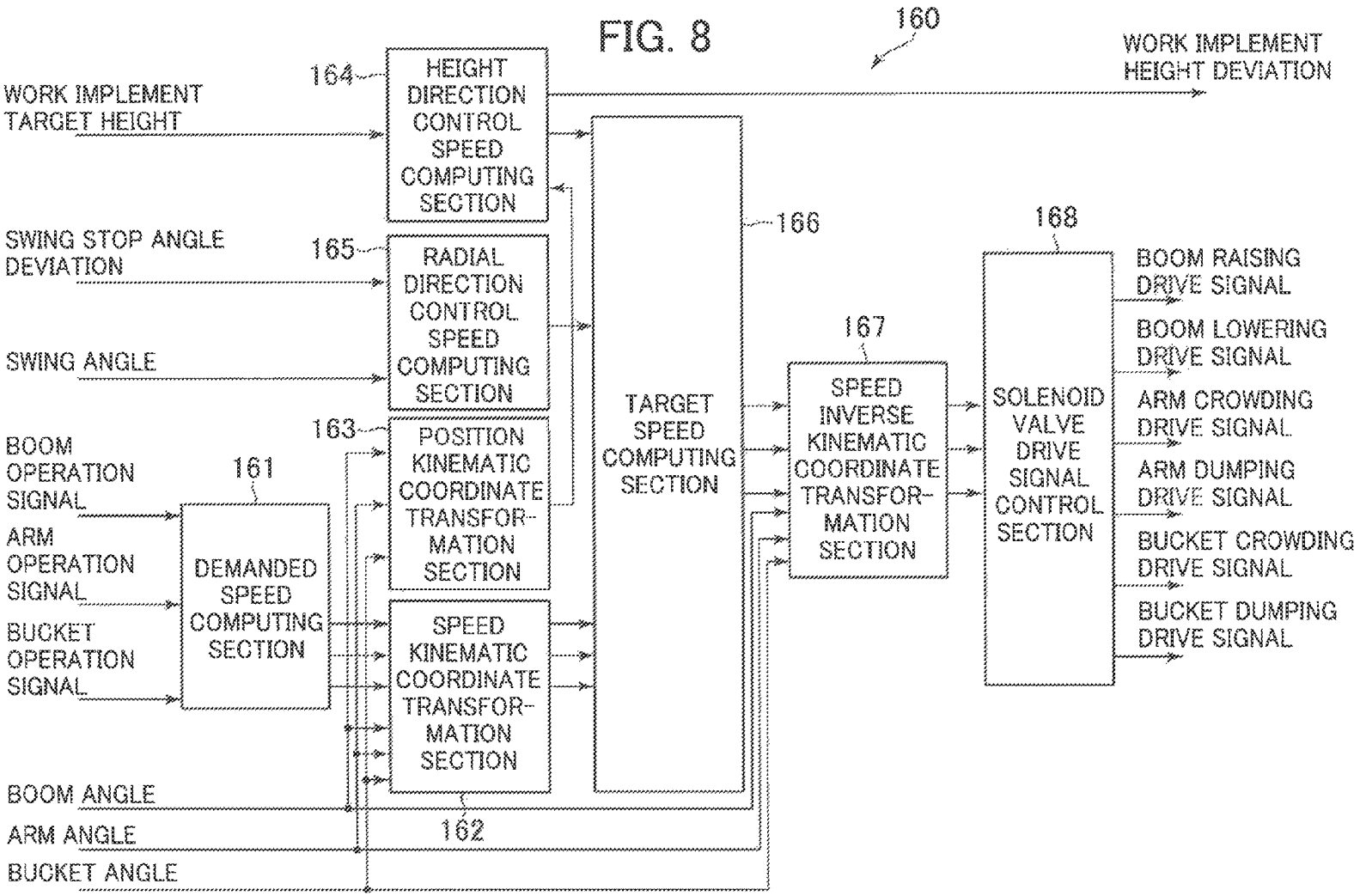
FIG. 8 is a conceptual diagram showing a configuration of a work implement control section of the main controller that configures the one embodiment of the control system for the construction machine according to the present invention.

The details of the computation performed by the work implement control section 160 will next be explained with reference to FIG. 8. FIG. 8 is conceptual diagram showing a configuration of the work implement control section of the main controller that configures the one embodiment of the control system for the construction machine according to the present invention. As shown in FIG. 8, the work implement control section 160 of the main controller 100 includes a demanded speed computing section 161, a speed kinematic coordinate transformation section 162, a position kinematic coordinate transformation section 163, a height direction control speed computing section 164, a radial direction control speed computing section 165, a target speed computing section 166, a speed inverse kinematic coordinate transformation section 167, and a solenoid valve drive signal control section 168.

The boom and the bucket operation signal from the right operation lever device 1*c* and the arm from the left operation lever device 1*d* are input to the demanded speed computing section 161. The demanded speed computing section 161 computes a boom demanded speed signal, an arm demanded speed signal, and a bucket demanded speed signal as demanded speeds to the boom cylinder 5, the arm cylinder 6, and the bucket cylinder 7, respectively, and outputs the boom demanded speed signal, the arm demanded speed signal, and the bucket demanded speed signal to the speed kinematic coordinate transformation section 162.

The boom angle signal from the second angle sensor 13*b*, the arm angle signal from the third angle sensor 13*c*, and the bucket angle signal from the fourth angle sensor 13*d* as well as the demanded speed signals described above are input to the speed kinematic coordinate transformation section 162. The speed kinematic coordinate transformation section 162 computes a work implement radial direction demanded speed signal, a work implement height direction demanded speed signal, and a work implement demanded angular speed signal from the demanded speed signals by performing well-known kinematic coordinate transformation based on the angle signals, and outputs the work implement radial direction demanded speed signal, the height direction demanded speed signal, and the work implement demanded angular speed signal to the target speed computing section 166.

The boom angle signal from the second angle sensor 13*b*, the arm angle signal from the third angle sensor 13*c*, and the bucket angle signal from the fourth angle sensor 13*d* are input to the position kinematic coordinate transformation section 163. The position kinematic coordinate transformation section 163 computes a work implement height signal by performing well-known kinematic coordinate transformation, and outputs the work implement height signal to the height direction control speed computing section 164. The work implement target height signal from the work implement target height setting section 130 as well as the work implement height signal is input to the height direction control speed computing section 164. The height direction control speed computing section 164 computes a height direction control speed signal and the work implement height deviation signal on the basis of the input signals, outputs the height direction control speed signal to the target speed computing section 166, and outputs the work implement height deviation signal to the swing stop target angle setting section 120. Details of computation performed by the height direction control speed computing section 164 will be described later.

The swing stop angle deviation signal from the swing stoppability determination section 140 and the swing angle signal from the first angle sensor 13*a* are input to the radial direction control speed computing section 165. The radial direction control speed computing section 165 computes a radial direction control speed signal on the basis of the input signals, and outputs the radial direction control speed signal to the target speed computing section 166. Details of computation performed by the radial direction control speed computing section 165 will be described later.

The work implement radial direction demanded speed signal, the height direction demanded speed signal, and the work implement demanded angular speed signal from the speed kinematic coordinate transformation section 162, the height direction control speed signal from the height direction control speed computing section 164, and the radial direction control speed signal from the radial direction control speed computing section 165 are input to the target speed computing section 166. The target speed computing section 166 computes a radial direction target speed signal, a height direction target speed signal, and a work implement target angular speed signal on the basis of the input signals, and outputs the radial direction target speed signal, the height direction target speed signal, and the work implement target angular speed to the speed inverse kinematic coordinate transformation section 167. Details of computation performed by the target speed computing section 166 will be described later.

The boom angle signal from the second angle sensor 13*b*, the arm angle signal from the third angle sensor 13*c*, and the bucket angle signal from the fourth angle sensor 13*d* as well as the target speed signals (and the target angular speed) described above are input to the speed inverse kinematic coordinate transformation section 167. The speed inverse kinematic coordinate transformation section 167 computes a boom target speed signal, an arm target speed signal, and a bucket target speed signal from the radial direction target speed signal, the height direction target speed signal, and the work implement target angular speed by performing well-known inverse kinematic coordinate transformation based on the angle signals, and outputs the boom target speed signal, the arm target speed signal, and the bucket target speed signal to the solenoid valve drive signal control section 168.

The solenoid valve drive signal control section 168 generates the boom raising drive signal, the boom lowering drive signal, the arm crowding drive signal, the arm dumping drive signal, the bucket crowding drive signal, and the bucket dumping drive signal depending on a boom target speed, an arm target speed, and a bucket target speed.

Figure 9:
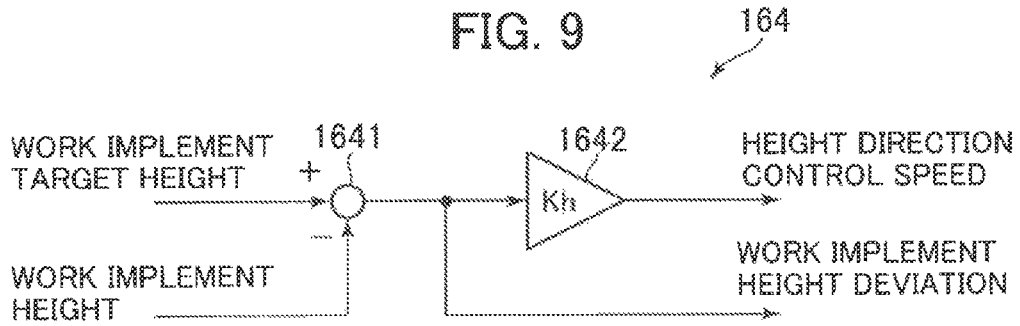
FIG. 9 is a control block diagram showing an example of computing contents of a height direction control speed computing section of the main controller that configures the one embodiment of the control system for the construction machine according to the present invention.

The details of the computation performed by the height direction control speed computing section 164 will next be explained with reference to FIG. 9. FIG. 9 is a control block diagram showing an example of computing contents of the height direction control speed computing section of the main controller that configures the one embodiment of the control system for the construction machine according to the present invention. The height direction control speed computing section 164 computes a work implement height deviation and the like on the basis of the work implement target height signal and the work implement height signal. The height direction control speed computing section 164 includes a subtracting element 1641 and a multiplying element 1642.

The work implement target height signal from the work implement target height setting section 130 and the work implement height signal from the position kinematic coordinate transformation section 163 are input to the subtracting element 1641. The subtracting element 1641 computes the deviation signal and outputs the deviation signal to the multiplying element 1642 and the swing stop target angle setting section 120. The multiplying element 1642 multiplies the deviation signal that is the input signal by a gain Kh to compute the height direction control speed signal, and outputs the height direction control speed signal to the target speed computing section 166. The gain Kh is a well-known P gain for feedback control and set such that the height direction control speed signal becomes larger in a direction in which the work implement is raised as the work implement height deviation signal is larger.

Figure 10:
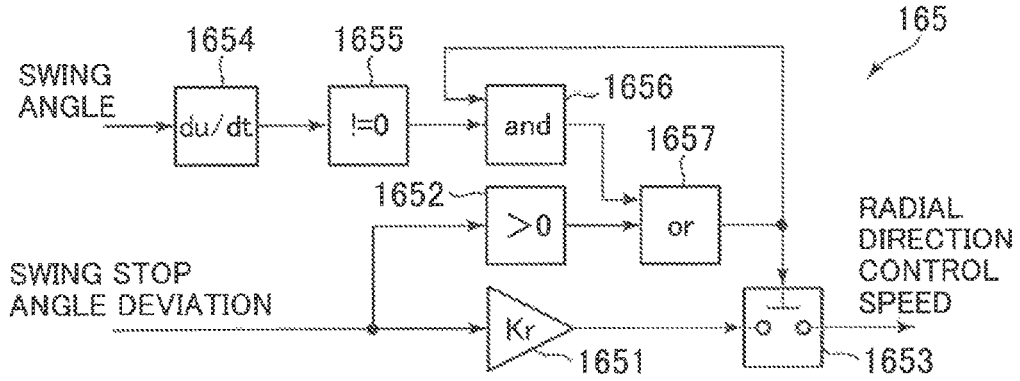
FIG. 10 is a control block diagram showing an example of computing contents of a radial direction control speed computing section of the main controller that configures the one embodiment of the control system for the construction machine according to the present invention.

The details of the computation performed by the radial direction control speed computing section 165 will next be explained with reference to FIG. 10. FIG. 10 is a control block diagram showing an example of computing contents of the radial direction control speed computing section of the main controller that configures the one embodiment of the control system for the construction machine according to the present invention. The radial direction control speed computing section 165 multiplies the swing stop angle deviation signal by a gain Kr to compute the radial direction control speed signal, and outputs the radial direction control speed signal to the target speed computing section 166 when a predetermined condition is satisfied. The radial direction control speed computing section 165 includes a multiplying element 1651, a first determination element 1652, a conditional connecting element 1653, a differentiating element 1654, a second determination element 1655, an AND computing element 1656, and an OR computing element 1657.

The swing stop angle deviation signal from the swing stoppability determination section 140 is input to the multiplying element 1651. The multiplying element 1651 multiplies the swing stop angle deviation signal by the gain Kr to compute the radial direction control speed signal, and outputs the radial direction control speed signal to the conditional connecting element 1653. The swing stop angle deviation signal is input to the first determination element 1652. The first determination element 1652 outputs a logical signal 1 to the OR computing element 1657 when determining that the input signal is a positive value.

An output from the AND computing element 1656 and an output from the first determination element 1652 are input to the OR computing element 1657. The OR computing element 1657 outputs an OR signal to the conditional connecting element 1653 and the AND computing element 1656. The radial direction control speed signal from the multiplying element 1651 and the OR signal from the OR computing element 1657 are input to the conditional connecting element 1653. When the OR signal is 1, the conditional connecting element 1653 enables connection between the conditional connecting element 1653 and the multiplying element 1651 element and validly outputs the radial direction control speed signal to the target speed computing section 166. When the OR signal is 0, the conditional connecting element 1653 disables the connection and outputs an invalid value to the target speed computing section 166.

The gain Kr of the multiplying element 1651 is a well-known P gain for the feedback control, and is set such that the multiplying element 1651 computes the radial direction control speed in a direction in which the work implement is made closer to the swing axis as the swing stop angle deviation is larger to cause the work implement to execute a contraction action.

The swing angle signal from the first angle sensor 13*a* is input to the differentiating element 1654. The differentiating element 1654 calculates the swing angular speed signal by performing differential computation and outputs the swing angular speed signal to the second determination element 1655. When determining that the input swing angular speed signal is not generally zero, the second determination element 1655 outputs a logical signal 1 to the AND computing element 1656. The AND computing element 1656 outputs an AND signal obtained by AND between the logical signal from the OR computing element 1657 and the logical signal from the second determination element 1655 to the OR computing element 1657.

This circuit operates in such a manner that even when the second determination element 1655 determines that the swing angular speed signal is not generally zero and it is determined that the swing stop angle deviation is the positive value, the connection between the conditional connecting element 1653 and the multiplying element 1651 is enabled and the radial direction control speed signal is validly output. Through this operation, even when the swing stop angle deviation signal becomes zero after it is determined once that the swing stop angle deviation signal is the positive value, the radial direction control speed signal is set to zero and output until the swing is stopped (the swing angular speed signal becomes generally zero). It is, therefore, possible to prohibit the work implement from executing an extension action in a direction in which the swing moment of inertia increases.

Figure 11:
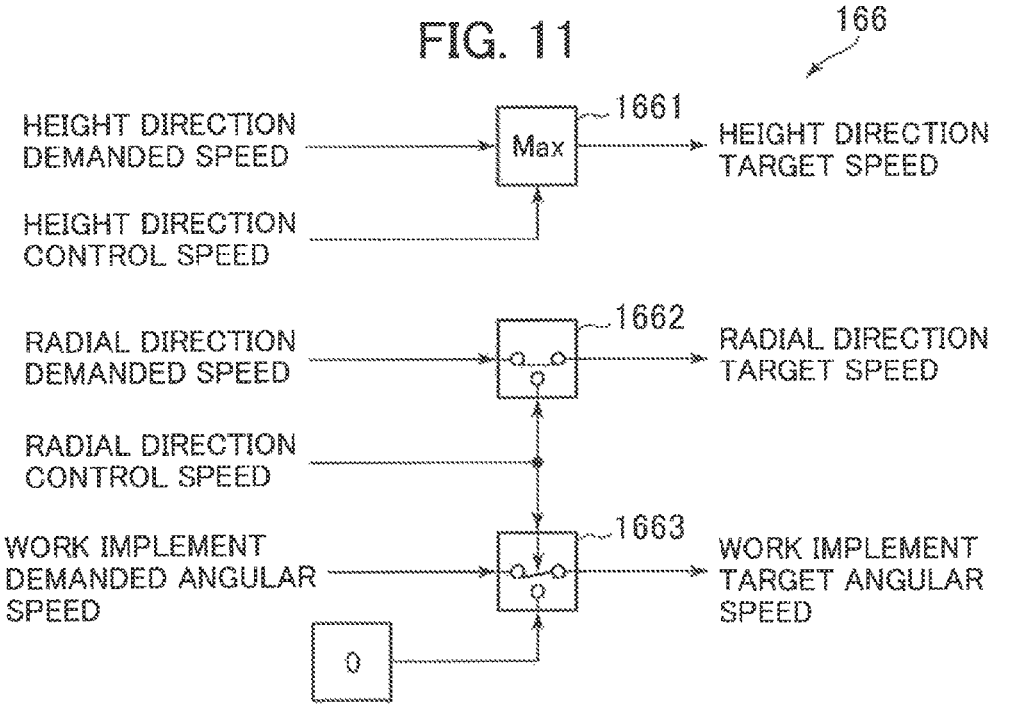
FIG. 11 is a control block diagram showing an example of computing contents of a target speed computing section of the main controller that configures the one embodiment of the control system for the construction machine according to the present invention.

The details of the computation performed by the target speed computing section 166 will next be explained with reference to FIG. 11. FIG. 11 is a control block diagram showing an example of computing contents of the target speed computing section of the main controller that configures the one embodiment of the control system for the construction machine according to the present invention. The target speed computing section 166 includes a maximum value selecting element 1661, a selecting element 1662, and a conditional switch element 1663.

The height direction demanded speed signal from the speed kinematic coordinate transformation section 162 and the height direction control speed signal from the height direction control speed computing section 164 are input to the maximum value selecting element 1661. The maximum value selecting element 1661 selects the larger signal out of the two speed signals, and outputs the selected signal to the speed inverse kinematic coordinate transformation section 167 as the height direction target speed signal.

The radial direction demanded speed signal from the speed kinematic coordinate transformation section 162 and the radial direction control speed signal from the radial direction control speed computing section 165 are input to the selecting element 1662. When the radial direction control speed signal is not input, the selecting element 1662 selects the radial direction demanded speed signal. When the radial direction control speed signal is input, the selecting element 1662 selects the radial direction control speed signal and outputs the radial direction control speed signal to the speed inverse kinematic coordinate transformation section 167 as the radial direction target speed signal.

The work implement demanded angular speed signal from the speed kinematic coordinate transformation section 162 and the radial direction control speed signal from the radial direction control speed computing section 165 are input to the conditional switch element 1663. When the radial direction control speed signal is not input, the conditional switch element 1663 outputs the work implement demanded angular speed signal to the speed inverse kinematic coordinate transformation section 167 as the work implement target angular speed. When the radial direction control speed signal is input, the conditional switch element 1663 outputs a zero signal to the speed inverse kinematic coordinate transformation section 167 as the work implement target angular speed.

Figure 12:
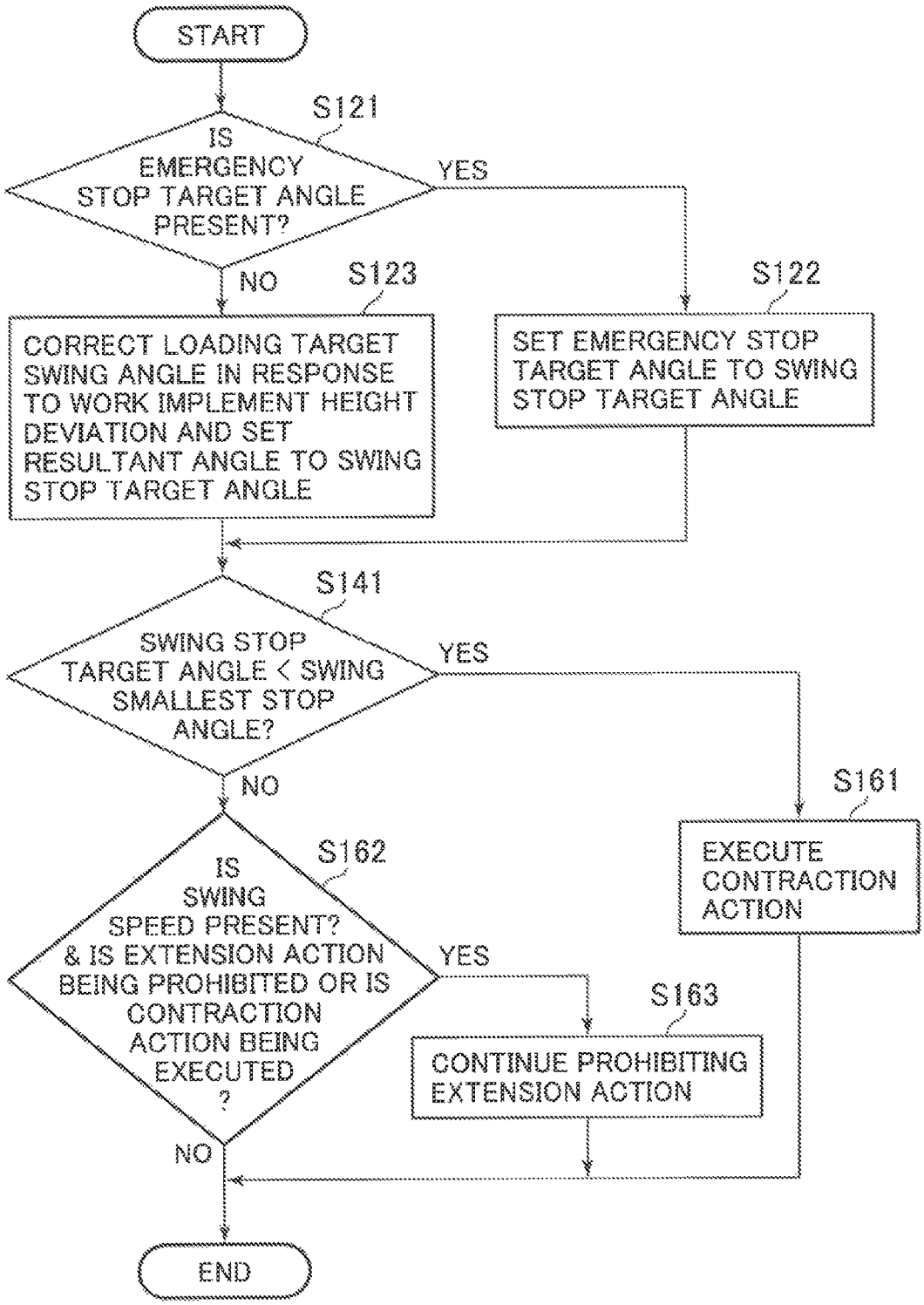
FIG. 12 is a flowchart showing an example of a computing flow of the main controller that configures the one embodiment of the control system for the construction machine according to the present invention.

An operation performed by the one embodiment of the control system for the construction machine according to the present invention described above will next be explained with reference to FIG. 12. FIG. 12 is a flowchart showing an example of a computing flow of the main controller that configures the one embodiment of the control system for the construction machine according to the present invention.

The main controller 100 determines whether the emergency stop target angle is present (Step S121). Specifically, the main controller 100 determines whether the interference avoidance control section 170 receives the position information on the approaching object from the radar device 32 and outputs the emergency stop target angle signal to the swing stop target angle setting section 120. When the emergency stop target angle is present, processing goes to (Step S122); otherwise, the processing goes to (Step S123).

The main controller 100 sets the emergency stop target angle to the swing stop target angle (Step S122). Specifically, the swing stop target angle setting section 120 sets the emergency stop target angle signal from the interference avoidance control section 170 to the swing stop target angle. The swing stop target angle depending on the position of the approaching object is thereby set when the approaching object is detected; thus, it is possible to avoid the interference between the work implement and the approaching object.

When the emergency stop target angle is not present in (Step S121), the main controller 100 corrects the loading target swing angle depending on the work implement height deviation and sets the resultant angle to the swing stop target angle (Step S123). Specifically, the swing stop target angle setting section 120 computes the correction amount signal depending on the work implement height deviation signal and subtracts the correction amount from the loading target swing angle. For example, when the work implement height is smaller than the work implement target height, the deviation signal becomes larger and the correction amount becomes larger as well; thus, the swing stop target angle becomes smaller. This can avoid the interference of the work implement with the dump truck or the like.

After execution of the processing in (Step S122) or (Step S123), the main controller 100 determines whether the swing stop target angle is smaller than the swing smallest stop angle (Step S141). Specifically, the swing stoppability determination section 140 computes the deviation between the relative value of the swing stop target angle to the swing angle and the swing smallest stop angle, and determines that the swing smallest stop angle is larger when this deviation is the positive value. When the swing stop target angle is smaller than the swing smallest stop angle, the processing goes to (Step S161); otherwise, the processing goes to (Step S162).

When the swing stop target angle is smaller than the swing smallest stop angle, the main controller 100 controls the work implement to execute a contraction action (Step S161). Specifically, the swing stoppability determination section 140 determines that the swing cannot be stopped before the angle of the upper swing structure 10 reaches the swing stop target angle, and outputs the positive value that is the deviation described above to the work implement control section 160 as the swing stop deviation signal. The work implement control section 160 computes the radial direction control speed in the direction in which the work implement is made closer to the swing axis on the basis of this swing stop deviation signal. The work implement thereby executes the contraction action. As a result, the swing moment of inertia decreases and it is possible to stop the upper swing structure at the desired swing stop angle.

On the other hand, when the swing stop target angle is not smaller than the swing smallest stop angle in (Step S141), the main controller 100 determines whether the swing speed is present and either whether the extension action of the work implement is being prohibited or the contraction action is being executed by the work implement (Step S162). Specifically, there is provided a so-called self-holding circuit that outputs the radial direction control speed signal even when the radial direction control speed computing section 165 of the work implement control section 160 computes the swing angular speed from the swing angle, determines that the swing angular speed is not generally zero, and determines that the swing stop angle deviation is the positive value using the logical computing elements. When the swing speed is present and either the extension action of the work implement is being prohibited or the contraction action of the work implement is being executed, the processing goes to (Step S163); otherwise, the processing goes to END to end the processing.

When the swing speed is present and either the extension action of the work implement is being prohibited or the contraction action of the work implement is being executed, the main controller 100 prohibits the work implement from executing the extension action (Step S163). Specifically, even when the swing stop angle deviation becomes zero after the radial direction control speed computing section 165 of the work implement control section 160 determines once that the swing stop angle deviation is the positive value, the self-holding circuit described above continues to set the radial direction control speed to zero until the swing is stopped, thereby prohibiting the work implement from executing the extension action. It is thereby possible to prevent the swing moment of inertia from increasing and stop the upper swing structure at the desired swing stop angle.

After execution of the processing in (Step S161) or (Step S163), the processing goes to END to end the processing.

The one embodiment of the control system for the construction machine of the present invention includes the swing stoppability determination section 140 that determines whether the swing can be stopped, and the work implement control section 160 that either prohibits the work implement from executing the extension action in a swing radial direction or allows the work implement to execute the contraction action in the swing radial direction in response to the signal indicating whether the swing can be stopped. Therefore, it is possible to suppress the increase of the swing inertia and reduce the swing inertia. It is thereby possible to stop the upper swing structure 10 at the desired swing stop angle.

While an example of using the second to fourth angle sensors provided near the coupling portions as sections that detect the angles of the boom 11, the arm 12, and the bucket 8, respectively has been explained in the explanation of the one embodiment of the present invention, the sections that detects the angles thereof are not limited to the angle sensors. For example, the control system for the construction machine may be configured such that the boom cylinder 5, the arm cylinder 6, and the bucket cylinder 7 include stroke sensors that detect strokes of cylinder rods, and such that the angles of the boom 11, the arm 12, and the bucket 8 are calculated on the basis of the strokes of the cylinder rods, respectively.

It is noted that the present invention is not limited to the embodiment described above but encompasses various modifications. For example, the present invention has been explained while the hydraulic excavator is taken by way of example in the above embodiment; however, the present invention is not limited to the hydraulic excavator. The present invention is also applicable to a crane or the like if the crane or the like includes a swing structure and a work implement.

Furthermore, the above embodiments have been explained in detail for facilitating understanding the present invention, and the present invention is not always limited to the control system for the construction machine having all the configurations explained above.

DESCRIPTION OF REFERENCE CHARACTERS

4: Swing hydraulic motor
5: Boom cylinder
6: Arm cylinder
7: Bucket cylinder
9: Undercarriage
10: Upper swing structure
15: Work implement
13*a:* First angle sensor
13*b:* Second angle sensor
13*c:* Third angle sensor
13*d:* Fourth angle sensor
22*a* to 22*h:* Solenoid proportional valve
32: Radar device
100: Main controller
110: Work implement target position setting section
120: Swing stop target angle setting section
130: Work implement target height setting section
140: Swing stoppability determination section
150: Swing control section
160: Work implement control section

The invention claimed is:

1. A control system for a construction machine comprising:

an undercarriage;

an upper swing structure rotatably mounted to swing on the undercarriage;

a work implement attached to the upper swing structure to be able to rotate vertically thereto;

a swing hydraulic actuator that drives the upper swing structure to swing;

work implement hydraulic actuators that drive the work implement;

a hydraulic pump;

work implement control valves and a swing control valve configured to exercise control of flow rates and directions of hydraulic fluids supplied from the hydraulic pump to the work implement hydraulic actuators and the swing hydraulic actuator;

work implement operation devices and a swing operation device configured to instruct the work implement and the upper swing structure to be actuated; and a main controller configured to output drive signals to the work implement control valves and the swing control valve on the basis of instruction signals from the work implement operation devices and the swing operation device, wherein the control system further comprises:

a first angle sensor configured to detect a swing angle of the upper swing structure with respect to the undercarriage; and a second angle sensor configured to detect an elevation angle of the work implement with respect to the upper swing structure, and the main controller comprises:

a swing stop target angle setting section configured to set a swing stop target angle of the upper swing structure;

a swing control section configured to calculate the drive signal on the basis of a difference between the swing angle of the upper swing structure detected by the first angle sensor and the swing stop target angle set by the swing stop target angle setting section and the instruction signal from the swing operation device, and to output the drive signal to the swing control valve;

a swing stoppability determination section configured to determine whether a swing action can be stopped before an angle of the upper swing structure reaches the swing stop target angle on the basis of the swing angle of the upper swing structure detected by the first angle sensor, the swing stop target angle set by the swing stop target angle setting section, and the elevation angle of the work implement detected by the second angle sensor; and a work implement control section configured to output a drive signal to the work implement control valve in such a manner that when a determination result of the swing stoppability determination section is No, an action of the work implement in a direction in which at least a swing moment of inertia increases is limited or prohibited.

2. The control system for the construction machine according to claim 1, wherein the swing stoppability determination section is configured to compute a swing smallest stop angle signal that is a minimum value of an increment of a swing stop angle by inertia on the basis of a swing speed signal calculated from the swing angle of the upper swing structure with respect to the undercarriage, a swing inertia moment signal calculated on the basis of the swing speed signal and the elevation angle of the work implement with respect to the upper swing structure, and the swing angle of the upper swing structure with respect to the undercarriage, and to determines that it is impossible to stop swing when the swing smallest stop angle signal is larger than the swing stop target angle.

3. The control system for the construction machine according to claim 1, further comprising:

a work implement target position setting section configured to set a work implement target position that is a target position at which a tip end of the work implement is disposed; and a work implement target height setting section configured to set a target height signal of the work implement on the basis of the work implement target position set by the work implement target position setting section, wherein the work implement control section is configured to calculate a height signal of the work implement on the basis of the elevation angle of the work implement with respect to the upper swing structure, and the swing stop target angle setting section is configured to compute a deviation between the target height signal of the work implement and the height signal of the work implement, and to correct the swing stop target angle depending on the deviation.

4. The control system for the construction machine according to claim 1, further comprising an approaching object sensor configured to detect a position of an approaching object around a work region, wherein the swing stop target angle setting section is configured to set the swing stop target angle depending on the position of the approaching object when receiving a position signal of the approaching object from the approaching object sensor.

* * * * *